US006318145B1

(12) United States Patent
Baba

(10) Patent No.: US 6,318,145 B1
(45) Date of Patent: Nov. 20, 2001

(54) TUBE EXPANDING BULLET AND METHOD OF EXPANDING TUBE

(75) Inventor: Yoshihiro Baba, Tokyo (JP)

(73) Assignee: Hidaka Seiki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/640,992

(22) Filed: Aug. 18, 2000

(30) Foreign Application Priority Data

Oct. 29, 1999 (JP) ..... 11-308529

(51) Int. Cl.[7] ..... B21D 53/08; B21D 39/20
(52) U.S. Cl. ..... 72/479; 72/478; 72/466
(58) Field of Search ..... 72/479, 478, 75, 72/466

(56) References Cited

U.S. PATENT DOCUMENTS 2,345,443 * 3/1944 Aiken ..... 72/479
3,470,729 * 10/1969 Anders et al. ..... 72/479
4,161,112 * 7/1979 Stump ..... 72/479
4,727,745 * 3/1988 Ferree ..... 72/478
6,017,489 * 1/2000 Woolf et al. ..... 72/479

FOREIGN PATENT DOCUMENTS

A4253531 9/1992 (JP) .
A7124670 5/1995 (JP) .

* cited by examiner

*Primary Examiner*—David Jones
(74) *Attorney, Agent, or Firm*—Birch, Stewart, Kolasch & Birch, LLP

(57) ABSTRACT

A tube expanding bullet is inserted into and expands a heat exchanger tube which has been pierced through collared fin holes of piled heat exchanging fins, so as to expand the fin holes and integrate the tube with the heat exchanging fins. The tube expanding bullet has a first part formed at a front part of the tube expanding bullet and a second part formed at a rear part of the tube expanding bullet whose maximum outer diameter is greater than that of the first part. The fin holes are firstly expanded by passing the first part of the bullet through the tube. The fin hole is secondly expanded by passing the second part of the bullet through the tube. A first rate of expansion of the fin hole by the first part of the tube expanding bullet is less than a second rate of expansion of the fin hole by the second part of the bullet.

10 Claims, 8 Drawing Sheets

TUBE EXPANDING BULLET AND METHOD OF EXPANDING TUBE

BACKGROUND OF THE INVENTION

1. Field of the Invention

The present invention relates to a tube expanding bullet and a method of expanding a tube. More particularly, the present invention relates to a tube expanding bullet capable of expanding a tube that is pierced through collared fin holes of heat exchanging fins so as to expand the fin holes and integrate the tube with the heat exchanging fins, and a method of expanding a tube with the tube expanding bullet.

2. Description of the Background Art

In heat exchangers of air conditioners, etc., a plurality of heat exchanging fins are integrated with tubes, through which cooling fluid passes, so as to effectively facilitate heat transfer. A plurality of heat exchanging fins, each of which has a plurality of fin holes, are piled to form a heat exchanging body to integrate the heat exchanging fins with the tubes. The tubes are pierced through the fin holes of the piled heat exchanging fins. Next, the tubes are expanded to integrate the heat exchanging fins with the tubes.

Conventionally, a tube expanding bullet 100 (see FIG. 6) is used to expand the heat exchanging tubes. The bullet 100 is formed having a columnar shape, and a maximum outer diameter is equal to an inner diameter of an expanded tube. The bullet 100 is fixed to a front end of a mandrel 102 by a cone-shaped member 106.

A male screw section 104, which is upwardly extended from the cone-shaped member 106, is pierced through the bullet 100. The male screw section 104 is screwed with the mandrel 102 to fix the bullet 100 to the mandrel 102.

A through-hole 108 is formed in the cone-shaped member 106. A front end of a screw driver can be inserted into the through-hole 108 so as to easily detach the bullet 100.

The tube 120 (see FIG. 7) is expanded by the bullet 100 shown in FIG. 6. The tube 120 is pierced through fin holes 116 of heat exchanging fins 110 as shown in FIG. 7. A collar 112, whose lower end is bent to form a flange section 114, is extended from an edge of each fin hole 116.

As shown in FIG. 7, the bullet 100, which has a circular projected section whose maximum outer diameter is "D", is inserted into the tube 120 which has already been pierced through the fin holes 116. By inserting the bullet 100, an inner diameter T of the tube 120 is extended to an expanded inner diameter T', which is equal to the maximum outer diameter D of the bullet 100.

Conventionally, the bullet 100 has the circular projected section whose maximum outer diameter is D to expand the tube 120 and the fin holes 116 and integrate the fins 110 with the tube 120. Inner circumferential faces of the collars 112 can be tightly fitted to an outer circumferential face of the tube 120.

However, in FIG. 7, some fins 110 are moved as shown by dotted lines 110' when the bullet 100 is passed through the tube 120. Accordingly, the moved fin 110' tightly contacts the adjacent fin 110. If some fins are moved and tightly contact adjacent fins, heat exchanging efficiency of the heat exchanger is lowered.

In order to avoid the tight contact of the fins which occurs by sudden expansion of the tube, the inventor of Japanese Patent Gazette No. 7-124670 invented an improved tube expanding bullet which was disclosed in Japanese Patent Gazette No. 7-124670. The improved bullet 200 is shown in FIG. 8.

The bullet 200 shown in FIG. 8 expands the tube 120 in two stages. Accordingly, the bullet 200 has a front part 202, in which a circular projected section having a maximum outer diameter A is formed; and a rear part 204, in which another circular projected section having a maximum outer diameter B is formed. The relationship between the maximum diameters A, B and an inner diameter T of the unexpanded tube is $T<A<B$.

By employing the bullet 200 shown in FIG. 8, the tube 120 is expanded by at least two stages, so that the force expanding the tube 120 can be dispersed evenly along the tube wall. With this dispersion, unlike the case of expanding the tube 120 with the bullet 100 shown in FIG. 7, the resulting tight contact of the heat exchanging fins 110 can be decreased.

However, even if the tube is expanded by the bullet 200, the tight contact of the heat exchanging fins cannot be perfectly prevented. In the case of using very thin and light heat exchanging fins, the fins are even more apt to become tightly contacted and displaced.

In an embodiment of Japanese Patent Gazette 7-124670, a small expanding force works to an inner face of the collar when the tube is firstly expanded and an outer face of the expanded tube lightly contacts the inner face of the collar. With such a small expanding force, the firstly-expanded tube cannot expand the fin hole, and the collar cannot be integrated with the firstly expanded tube. In the second expanding stage, the firstly-expanded tube is further expanded and finally integrated with the collar. As described hereinabove, the fin whose collar is expanded by the secondly-expanded tube is displaced and therefore tightly contacts the adjacent fin whose collar has not yet been expanded.

SUMMARY OF THE INVENTION

An object of the present invention is to provide a tube expanding bullet and a method of expanding a tube that are capable of preventing thin heat exchanging fins from becoming displaced and positioned with unfavorably tight contact.

The inventor of the present invention has studied the origin of the tight contact. The present inventor has found that the resulting tight contact of adjacent fins occurs at a non-expanded portion of the tube as well.

It appeared that the collar of the fin hole, which is expanded by the expanded tube, is extended so that the fin is moved and the undesirable tight contact of the adjacent fins occurs.

In the piled fins, as shown in FIG. 7, the flange 114 of each collar 112 contacts the lower adjacent fin 110. With this structure, the expanded and extended collar 112 pushes the lower adjacent fin 110 in which the nonexpanded part of the tube is pierced through the fin hole. The lower fin is not integrated with the tube, so the lower fin is easily moved by the extended collar 112 of the upper fin and the adjacent fins are moved into tight contact.

In order to prevent the tight contact of the fins, the present inventor found that the tube can be properly expanded with a tube expanding bullet such as the two-stage bullet 200 shown in FIG. 8. These and other objects of the present invention are accomplished by the steps of: firstly expanding the fin hole by the firstly-expanded tube so as to tightly fit the heat exchanging fin to the tube and further expanding the firstly-expanded tube.

The tube expanding bullet of the present invention is inserted into and expands a tube which has been pierced through a collared fin hole of a heat exchanging fin so as to expand the fin hole and integrate the tube with the heat exchanging fin. The tube expanding bullet comprises a first part being formed at a front part of the tube expanding bullet; and a second part, whose maximum outer diameter is greater than that of the first part, being formed at a rear part of the tube expanding bullet.

The fin hole is firstly expanded by passing the first part of the bullet through the tube and firstly expanding the tube, and the fin hole is secondly expanded by passing the second part of the bullet through the tube and secondly expanding the tube. The rate of expanding the fin hole by the first part is less than rate of expanding the same by the second part.

These and other objects of the present invention are accomplished by a method comprising the steps of: piercing a tube through collared fin holes of a plurality of heat exchanging fins which have been piled; and inserting a tube expanding bullet into the tube so as to expand the tube, whereby the fin holes are expanded by the expanded tube and the tube is integrated with the heat exchanging fins; expanding the tube by inserting the tube expanding bullet so as to expand the fin holes by a first expansion rate; and secondly expanding the firstly-expanded tube by the tube expanding bullet by a second expansion rate so as to further expand the expanded fin holes, wherein the first expansion rate of the fin holes is less than the second expansion rate of the fin holes.

The heat exchanging fins are piled and a front end of the collar of each fin hole contacts an adjacent fin. Then the tube is pierced through the collar and the fin hole. The tube is expanded, by at least two stages, by inserting the tube expanding bullet into the tube. The expanded tube expands the fin hole so as to integrate the fin with the tube. When the tube is expanded, the first part of the bullet, which is formed at the front part of the bullet, firstly expands the tube, and the firstly-expanded tube firstly expands the fin hole. By firstly expanding the tube and the fin hole, the fin can be firstly integrated with the tube.

Then, the second part of the bullet, which is formed at the rear part of the bullet, further expands the firstly-expanded tube and the firstly-expanded fin hole with a greater expansion rate so as to tightly integrate the fin with the expanded tube. When the fin hole is secondly expanded, the collar is extended and pushes the adjacent fin, but the adjacent fin has already been firstly integrated with the tube. Since the fins have been integrated with the tube, no fins are moved, and the undesirable tight contact or fit of the adjacent fins can be prevented.

In the tube expanding bullet and the method of the present invention, the maximum outer diameter of the first part may be designed to make the ratio of a first expansion width of the fin hole which has been expanded by the first part of the bullet to the sum of the first expansion width of the fin hole which has been expanded by the first part and the expansion width of the fin hole which has been expanded by the second part of the bullet 1:10.

And, the tube expanding bullet may further comprise a first circular projected section, whose maximum outer diameter is equal to that of the first part of the bullet formed at the front part of the tube expanding bullet; and a second circular projected section, whose maximum outer diameter is equal to that of the second part of the tube bullet formed at the rear part of the tube expanding bullet.

BRIEF DESCRIPTION OF THE DRAWINGS

Embodiments of the present invention will now be described by way of example and with reference to the accompanying drawings, in which.

DETAILED DESCRIPTION OF THE PREFERRED EMBODIMENTS

Preferred embodiments of the present invention will now be described in detail with reference to the accompanying drawings.

Figure 1:
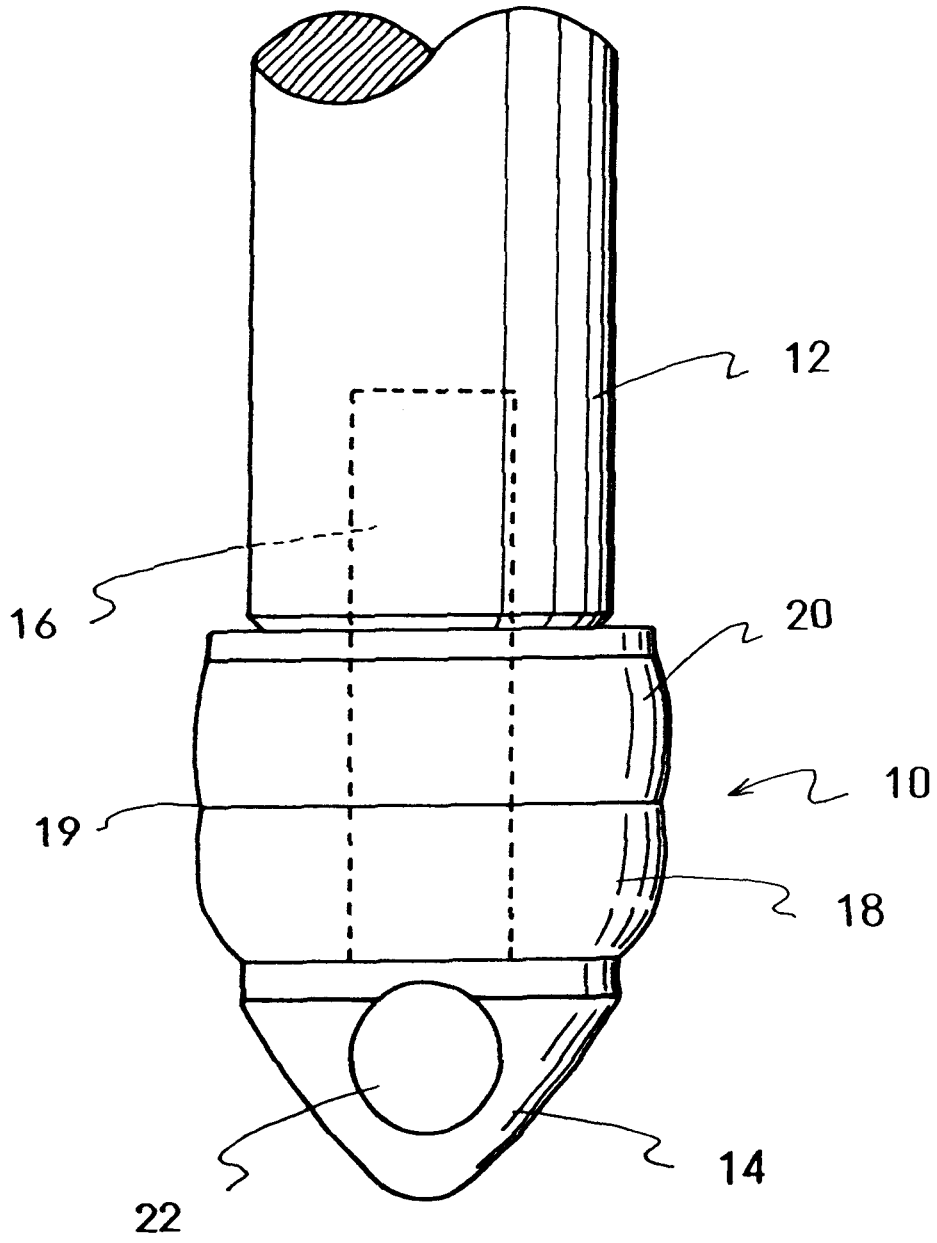
FIG. 1 is a front view of the tube expanding bullet of an embodiment of the present invention.

An embodiment of the tube expanding bullet of the present invention is shown in FIG. 1. The bullet 10 shown in FIG. 1 is capable of expanding a tube by two stages, so the bullet 10 has a front (lower) part 18 and a rear (upper) part 20, in each of which a circular projected section is formed. The bullet 10, including the front part 18 which acts as a first expanding part, and the rear part 20 which acts as a second expanding part, is fixed to a lower end of a mandrel 12 by a conically-shaped member 14.

A screw section 16 of the conically-shaped member 14 is pierced through the bullet 10 and screws to the lower end of the mandrel 12, so that the bullet 10 can be fixed to the mandrel 12.

A front end of a screw driver can be inserted into a throughhole 22 of the conically-shaped member 14 so as to easily detach the bullet 10.

Figure 2:
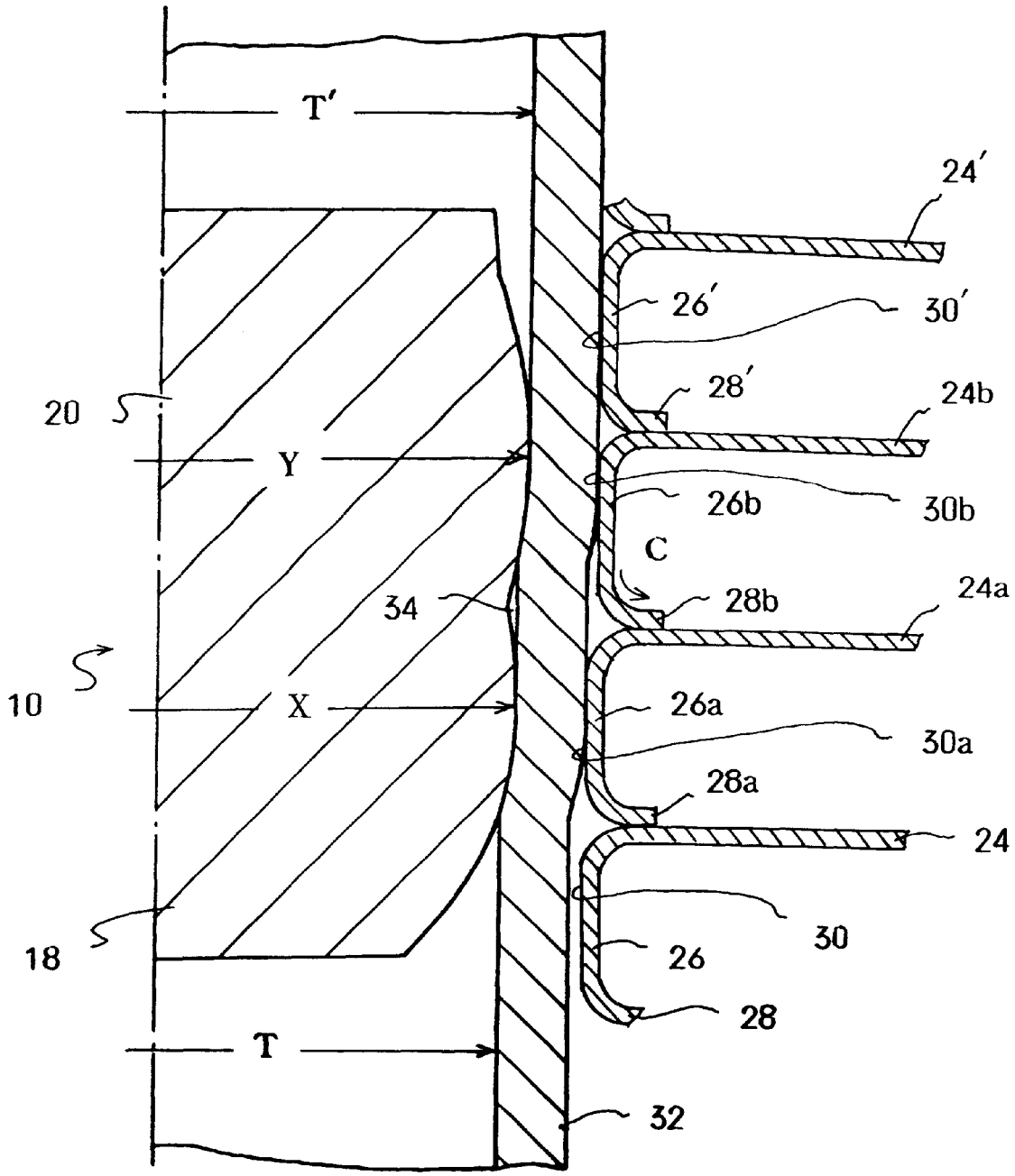
FIG. 2 is a partial sectional view of a tube and a fin hole expanded by the bullet shown in FIG. 1.

As shown in FIG. 2, the maximum outer diameter "Y" of the circular projected section of the rear part 20 of the bullet 10 is greater than a maximum outer diameter "X" of the front part 18 thereof. The relationship between the maximum diameters X, Y and an inner diameter T of the unexpanded tube is $T<X<Y$.

The front part 18 of the bullet 10 whose maximum outer diameter is X expands the tube 32 by passing the front part 18 of the bullet 10 through the tube 32 to produce a first expansion rate. With this first expansion rate, the expanded tube 32 expands the fin hole 30. And, the rear end part 20 of the bullet 10 whose maximum outer diameter is Y, further expands the firstly-expanded tube 32 and the fin hole 30 with a second expansion rate. The rate of expansion the fin hole 30 by the rear end part 20 (second expansion rate) is greater than the rate of expansion of the fin hole 30 by the front end part 18 (first expansion rate).

As shown in FIG. 2, the tube expanding bullet 10 shown in FIG. 1 is inserted into the tube 32, which has the initial inner diameter T and which is pierced through the collars 26. The collars 26 are respectively extended from the fin holes 32 and have lower ends formed into flanges 28. By inserting the bullet 10, the circular projected section of the front part 18 firstly expands the tube 32 according to a first expansion rate controlled by the maximum outer diameter X of the tube bullet 10. The firstly-expanded tube 32 pushes an inner face of the collar 26 of the fin hole 30 radially outward, so that the fin hole 30 can be expanded. By this first expansion of the tube 32, the inner face of the collar 26 of the fin hole 30 can be tightly fitted to the firstly-expanded tube 32, so that a heat exchanging fin 24 can be integrated with the firstly-expanded tube 32.

Successively, the circular projected section of the rear part 20 of the tube bullet 10 whose maximum outer diameter is Y, secondly expands the firstly-expanded tube 32 so that the secondly-expanded tube 32 has the desired inner diameter T'.

By expanding the tube 32 in two stages, the collar 26 of the fin hole 30 can be tightly integrated with the secondly-expanded tube 32, and the heat exchanging fin 24 can be tightly integrated with the secondly-expanded tube 32.

The bullet 10 is capable of expanding the tube 32 by two stages. A first rate of expansion of the fin hole 30 by the tube 32 that has been expanded in the first stage by the front part 18 (maximum diameter of X) of the tube bullet 10 is less than a second rate of expansion of the firstly-expanded fin hole 30 by the tube 32 that has been expanded in the second stage by the rear part 20 (maximum diameter of Y). Namely, the first expansion rate is less than the second expansion rate caused by the varying diameters of the tube bullet 10. Thus, in the first expanding stage, the tube 32 can be expanded with a relatively small expansion rate, wherein the extension of the collar 26 can be ignored.

The firstly-expanded tube 32 can be secondly expanded to T' by the rear part 20 having the maximum diameter Y. In the second expansion stage, the fin hole 30 is further expanded by the secondly-expanded tube 32, so that the collar 26 of the expanded fin hole 30 is extended. The extended collar 26 pushes the adjacent fin.

But, as shown in FIG. 2, parts of the tube 32, which correspond to other fins, have already been firstly or secondly expanded, so other fins have been integrated with the tube 32.

Therefore, other fins are never moved by the collar 32, which is extended in the second expansion stage.

Figure 3A:
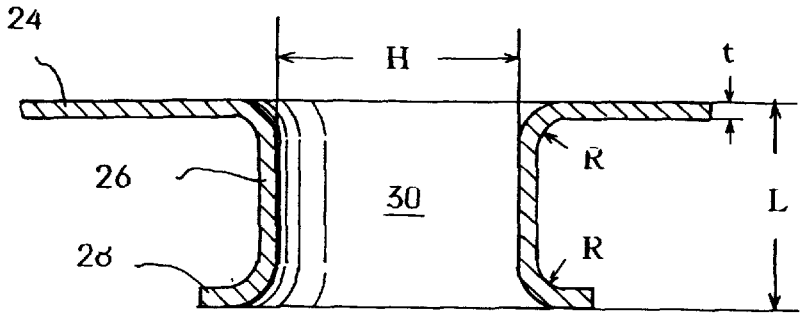
FIG. 3A is a sectional view of an unexpanded fin hole.

When the fin hole 30 of the fin 24 shown in FIG. 3A is expanded, the collar 26 of the fin hole 30 is extended. The collar 26 is extended from an edge of an opening section of the fin 24 and the lower end is bent to form the flange 28.

An example of the extension of the collar 26 will be explained hereinafter. In the present example, a thickness "t" of the heat exchanging fin 24 is 0.1 mm; an inner diameter H of the fin hole 30 is 9.9 mm; radii R of a border section between the fin 24 and the collar 26 and a border section between the collar 26 and the flange 28 are 0.1 mm; and a length L of the collar 26 is 1.2 mm. In the case of expanding the diameter H of the fin hole 30 from 9.9 mm to 10.0 mm, the length L of the collar 26 becomes 1.228 mm. Namely, the collar 26 is extended 0.028 mm. If each of the piled fins 24 is similarly extended, the total extension of 400 fins 24 which are piled is 11.2 mm.

With the extension of the collar 26 which occurs by expanding the fin hole 30 and the collar 26, the adjacent fin 24, which has been contacted by the flange 28 of the extended collar 26, and the collar 26 of the adjacent fin 24, are pushed by the extended collar 26.

Figure 8:
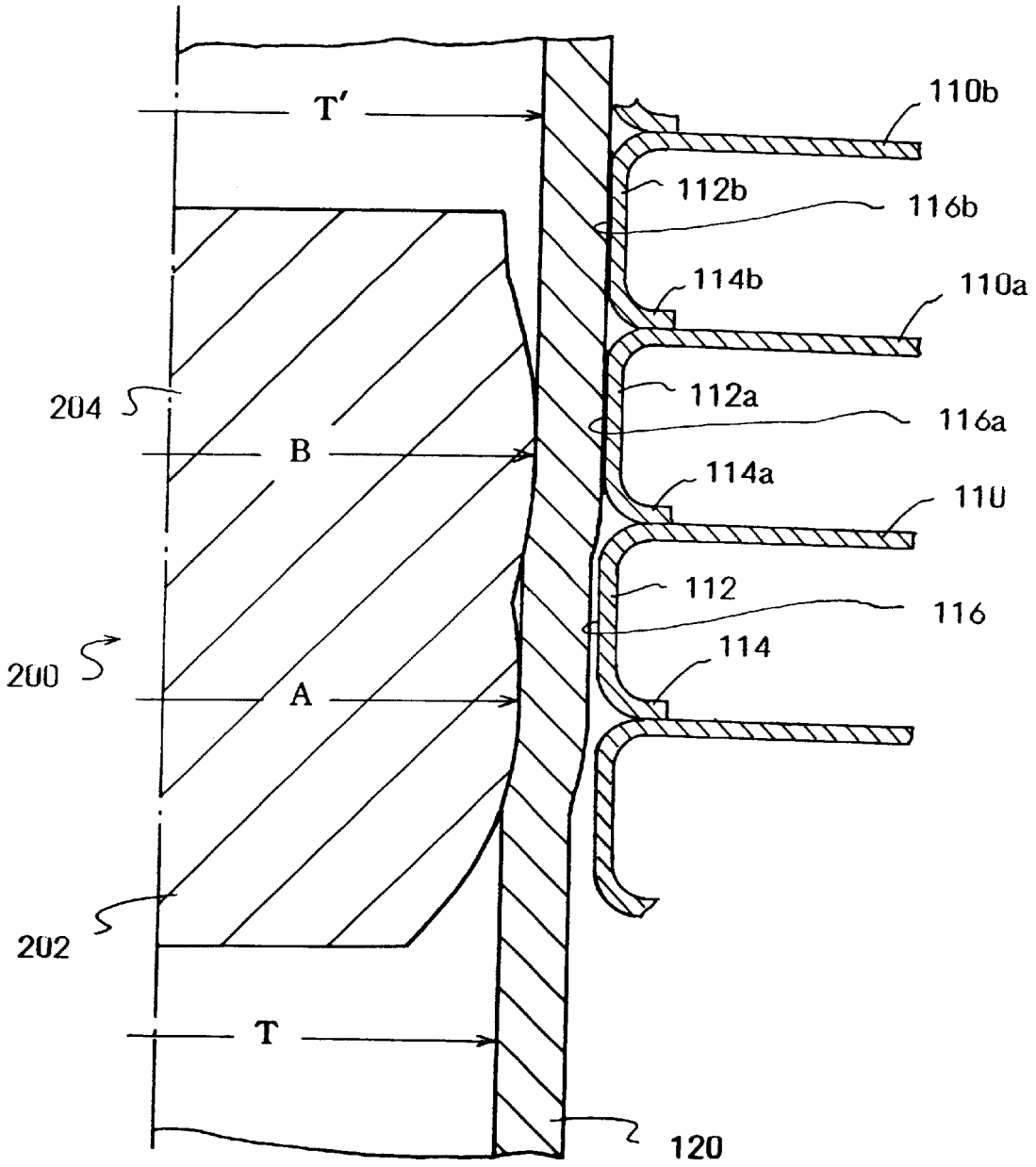
FIG.8 PRIOR ART
FIG. 8 is a partial sectional view of a tube and a fin hole expanded by the improved bullet.

The action of the extended collar 26 will be explained hereinafter with reference to FIG. 8. The tube expanding bullet 200 shown in FIG. 8 expands the tube by two stages. The fin hole 116 of the heat exchanging fin 110 is only expanded by the circular projected section of the rear end part 204 of the bullet 200 whose maximum outer diatmeter is B. Therefore, the extension of the collar 112*a*, which occurs by expanding the fin hole, occurs when the fin hole 116*a* of is expanded by the rear end part 204 of the bullet 200.

The pushing force from the extended collar 112*a* works to the adjacent fin 110*b*, whose flange 114*b* contacts the fin 110*a*, and another adjacent fin 110, which is contacted by the flange 114*a* of the collar 112*a*. But the fin hole 116*b* has been expanded by the rear end part 204 of the bullet 200, and the collar 112*b* is tightly integrated with the tube 120, so that the fin 110*b* is not moved by the pushing force of the collar 112*a*.

On the other hand, the fin hole 116 of the fin 110 is not expanded by the front end part 202 of the bullet 200, and the collar 112 is not integrated with the tube 120. Therefore, the fin 110 is easily moved by the pushing force of the collar 112*a*, so that the fin 110 is apt to tightly fit to another fin.

However, by employing the tube expanding bullet 10 of the present invention, the tube 32 and the fin hole 30 of the fin 24 can be expanded in two succesive stages. The expansion rate of the first stage is less than that of the second stage. Therefore, the bad influence by the extension of the collar 26, which occurs by expanding the fin hole 30, mainly occurs when the fin hole 30 is expanded in the second stage.

The inner face of the collar 26*a* of the fin hole 30*a*, which has been firstly expanded by the front part 18 of the bullet 10, is tightly integrated with the firstly-expanded tube 32. Further, the inner face of the collar 26' of the secondly-expanded fin hole 30' is also tightly integrated with the secondly-expanded tube 32. Therefore, the collar 26', whose flange 30' contacts the fin 24*b* having the secondly-expanded fin hole 26*b*, and the fin 24*a*, which is contacted by the flange 28*b* and the collar 26*b*, are tightly integrated with the expanded tube 32. With this structure, even if the fin 24*a* and the collar 26' are pushed by the collar 26*b* which is extended when the fin hole 26*b* is expanded in the second stage, the fins 24*a* and 24' are never moved, so that the tight contact or fit of the fins can be prevented.

Note that, the extension of the collar 26*b*, which occurs by expanding the fin hole 30*b* in the second stage, is absorbed by bending the flange 28*b* in a direction of an arrow C.

If the first expansion rate of the fin hole 30 is greater, the collar 26*a* of the fin hole 30*a*, which has been firstly expanded, pushes and moves the fin 24, which has not been integrated with the tube 32. In order to prevent this action, the first expansion rate of the fin hole 30 should be small, wherein the extension of the collar 26*a* can be ignored.

Figure 3B:
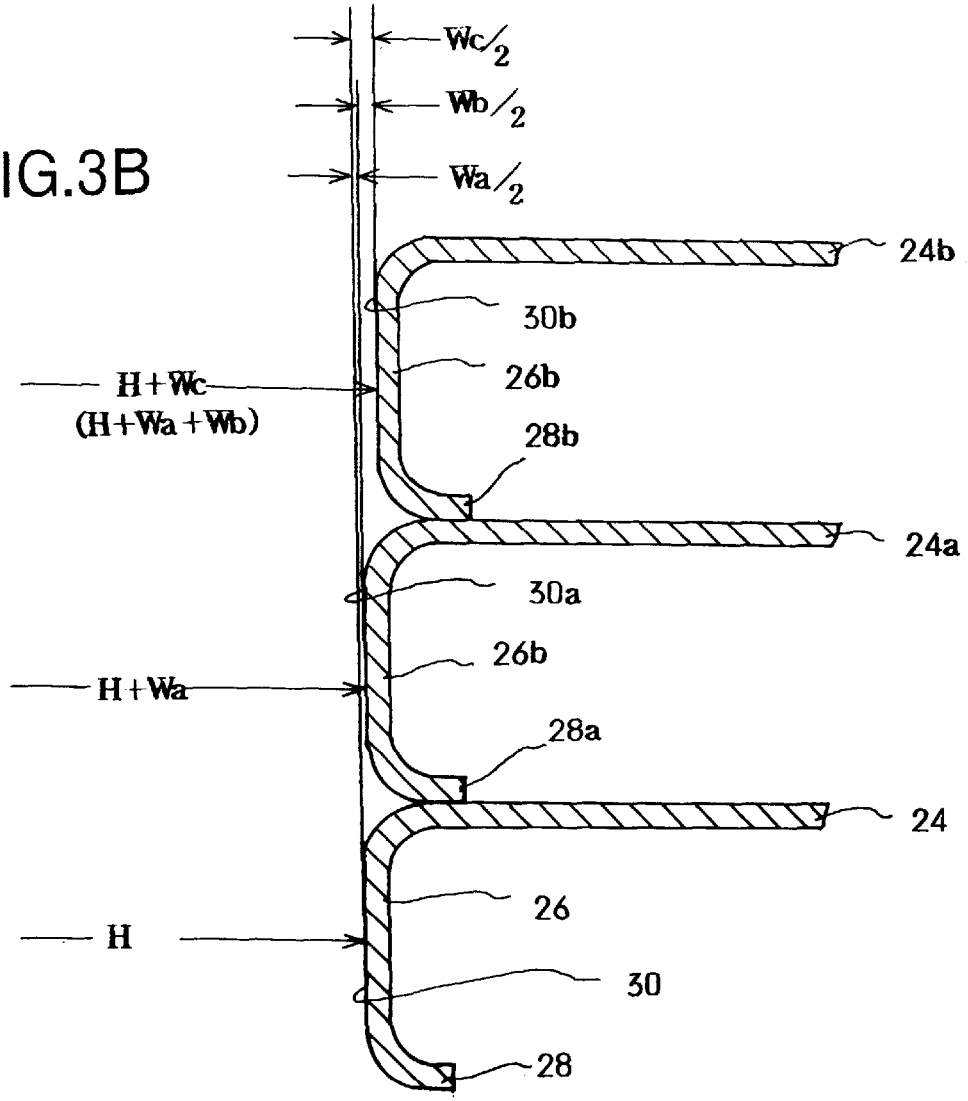
FIG. 3B is a partial sectional view of the fin holes of piled heat exchanging fins, through which the twice-expanded tube is pierced.

The expansion rate of the fin hole 30 will be explained hereinafter with reference to FIG. 3B. In FIG. 3B, a plurality of the piled fins 24 are shown which have the fin holes 30 shown in the FIG. 3A. The tube 32 has been pierced through the fin holes 30 of the fins 24. Next, the tube 32 is expanded by the tube bullet 30 shown in FIG. 1, by two stages as shown in FIG. 2 and described hereinabove.

In the example shown in FIG. 3B, an inner diameter of the non-expanded fin hole 30 is H. An inner diameter of the hole 30*a* of the fin 24*a* after the first expansion stage which is expanded by the tube 32 expanded in the first expanded stage is "H"+"Wa." The value "Wa" is an expanded width of the fin hole 30*a* which is expanded by the firstly-expanded tube 32 after the first expansion stage.

Further, an inner diameter of the fin hole 30*b* of the fin 24*b* after the second expansion stage is expanded by the tube 32 that has been expanded in the second expansion stage is H+Wa+Wb. The expanded width Wb of the fin hole 30*b* is that resulting after expansion by the secondly-expanded tube 32. Therefore, a total expanded width Wc of the fin hole 30*b*, which are expanded by the secondly-expanded tube 32, is the sum of Wa and Wb.

In the present example, the ratio of the expanded width Wa of the fin hole 30*a* which has been expanded by the firs expansion stage to the sum Wc of the expanded widths of the fin hole 30*b* which have been expanded by the first and second expansion stages (Wa;Wc) is 1:10. Thus, the extension of the collar 26*a* can be ignored.

Preferably, in the bullet 10, the maximum outer diameter X of the front end part 18 is designed to make the ratio of the expanded width Wa of the fin hole 30*a* which has been expanded by the first expansion stage 32 to the sum Wc of the expanded width of the fin hole 30*b* which has been expanded by the first and second expansion tube 32(Wa:Wc) 1:10.

In the case of expanding the inner diameter H of the fin hole 30 of the fin 24 shown in FIG. 3A from 9.9 mm to 10.0 mm by two stages, the bullet 10 preferably expands the inner diameter H to 9.91 mm in the first expansion stage. In this case, the extension of the collar 26 of the fin hole 30, which occurs by first expanding the fin hole 30, can be substantially ignored.

The bullet 10 shown in FIGS. 1 and 2 has a circular valley part 19 formed between the front end part 18 and the rear end part 20 so as to reduce friction between the bullet 10 and the inner face of the tube 32.

Since the bullet 10 has the circular valley part 19, a space 34 is formed between the inner face of the tube 32 which has been firstly expanded, and the circular valley part 19. The inner diameter of a part of the expanded tube 32, which corresponds to the circular valley part 19, may be reduced by a springback phenomenon where the inner diameter springs back into the unexpanded position.

Figure 4:
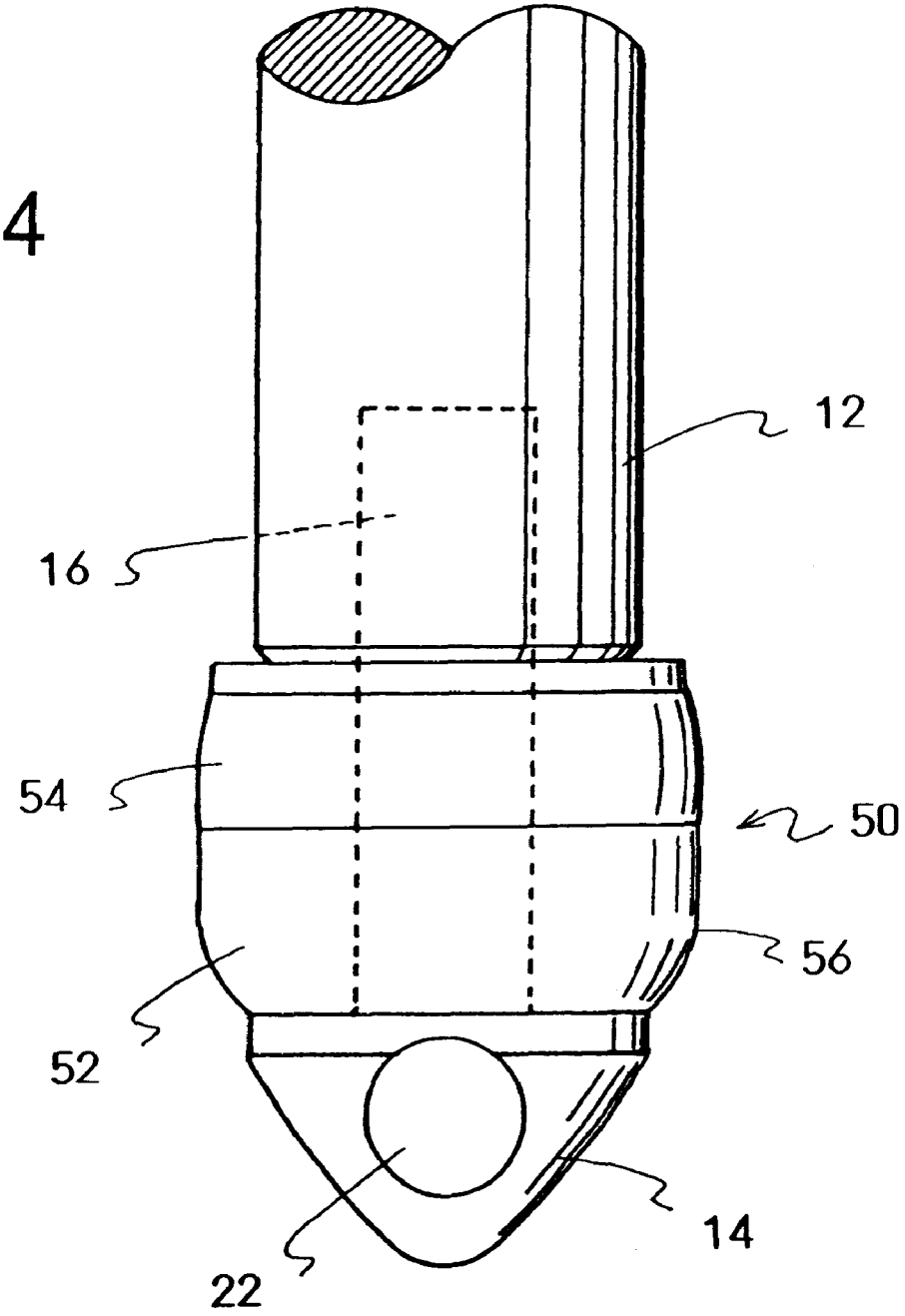
FIG. 4 is a front view of the tube expanding bullet of another embodiment of the present invention.

Therefore, in the case of expanding the tube whose material is apt to make the spring-back phenomenon, a tube expanding bullet 50 shown in FIG. 4 is capable of effectively preventing the spring-back phenomenon.

The bullet 50 shown in FIG. 4 is pierced by the screw section 16 of the cone-shaped member 14. The screw section 16 is screwed with the front (lower) end of the mandrel 12 so that the bullet 50 can be fixed to the mandrel 12 as well as the bullet 10 shown in FIG. 1.

The bullet 50 has a front end part 52 and a rear end part 54. The rear end part 54 includes a circular projected section whose maximum outer diameter is Y (see FIG. 5).

On the other hand, the front end part 52 includes a cylindrical section, which is extended from a border between the front end part 52 and the rear end part 54, and a tapered section, which is extended from the lower end of the cylindrical section and whose diameter is gradually reduced toward the conically-shaped member 14. The maximum outer diameter of the front end part 52 is equal to an outer diameter X (see FIG. 5) of the cylindrical section.

Figure 5:
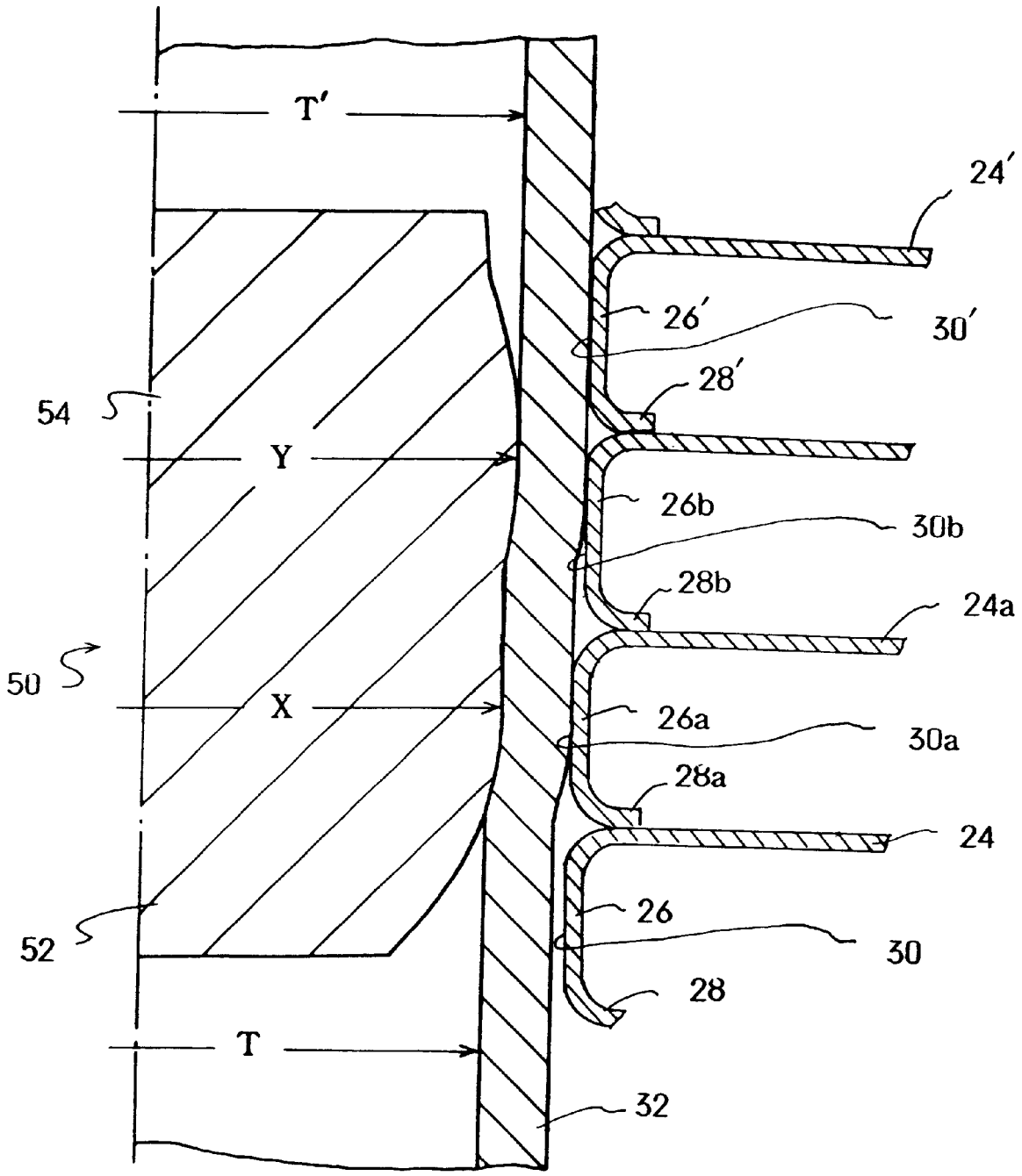
FIG. 5 is a partial sectional view of the tube and the fin hole expanded by the bullet shown in FIG. 4.
Figure 6:
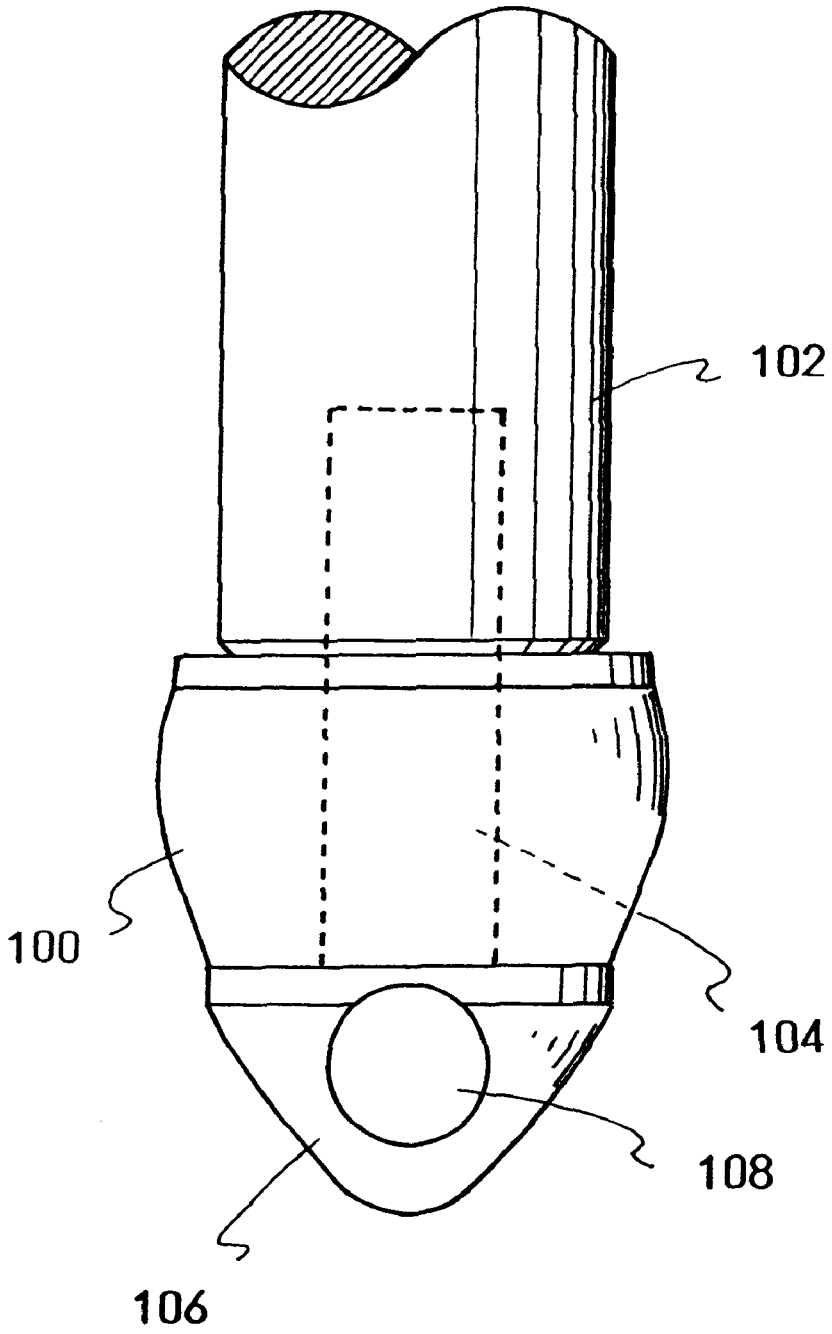
FIG.6 PRIOR ART
FIG. 6 is a front view of a conventional tube expanding bullet.
Figure 7:
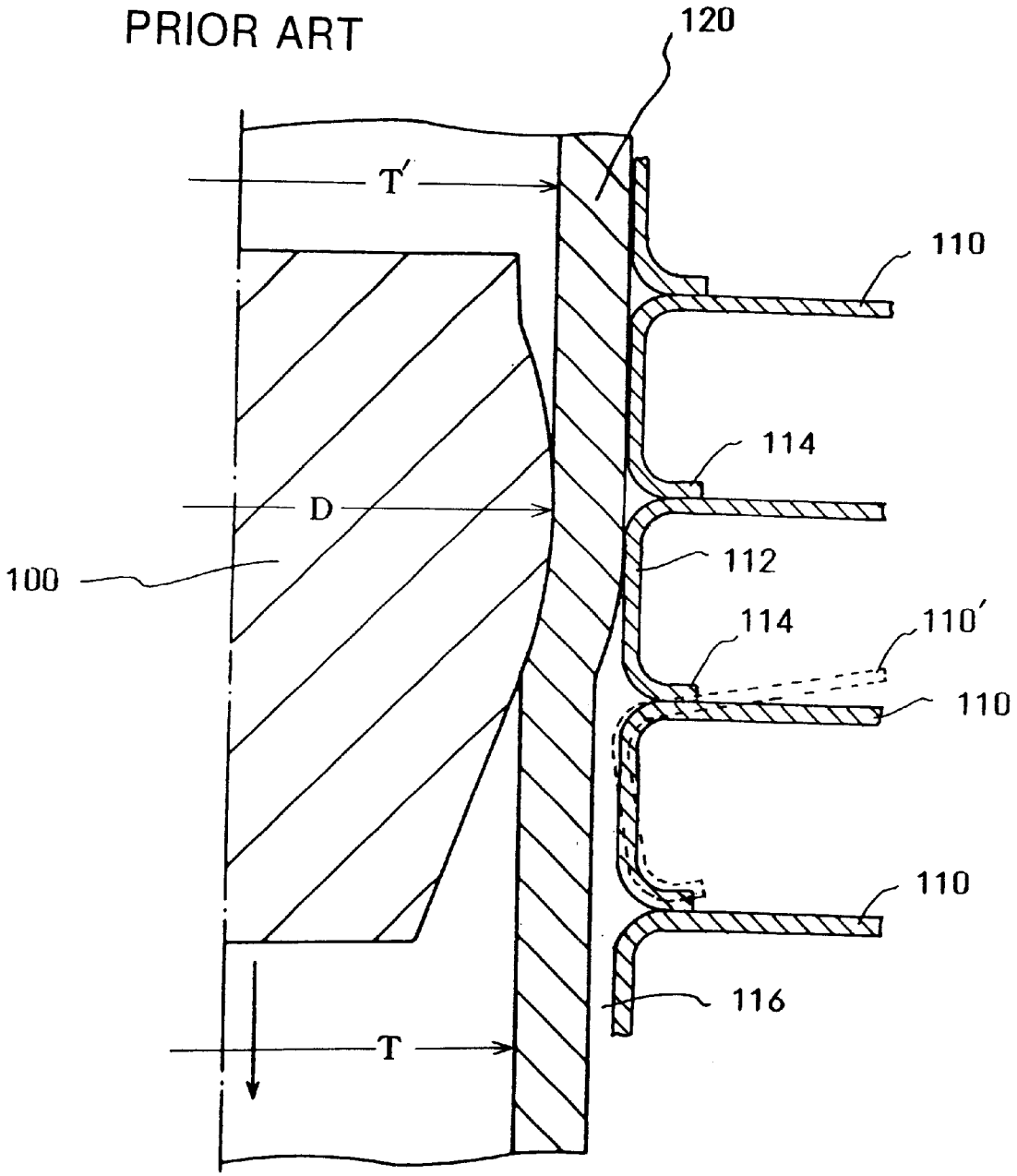
FIG.7 PRIOR ART
FIG. 7 is a partial sectional view of a tube and a fin hole expanded by the conventional bullet shown in FIG. 6.

The bullet 50 shown in FIG. 5 does not have a circular valley part between the front end part 52 and the rear end part 54.

Note, that the bullet 50 firstly expands the tube by the cylindrical section and a part 56.

In the bullet 50, the diameter X of the cylindrical section of the front end part 52 is less than the maximum outer diameter Y of the circular projected section of the rear end part 54. The relationship between the maximum diameters X, Y and the inner diameter T of the unexpanded tube is T<X<Y.

The outer diameter X of the cylindrical section of the front end part 52 is designed to expand the tube 32 in a first expansion stage. When the cylindrical section of the front end part 52 of the bullet 50 is inserted into the tube 32 and expands the tube 32 in the first expansion stage, the fin hole 30 can be firstly expanded by the firstly expanded tube 32 (see FIG. 5).

The diameter X is less than the diameter Y. Further, the rate of expansion of the fin hole 30 by the tube 32 expanded by the first expansion stage is less than the rate of expansion of the firstly-expanded fin hole 30 by the tube 32 expanded by the second expansion stage (expanded by the rear end part 54 of the bullet 50).

By inserting the bullet 50 shown in FIG. 4 into the tube 32, the fin hole 30 is firstly expanded by the firstly-expanded tube 32 in a first expansion stage (by the part 56 of the front end part 52), so that the firstly-expanded collar 26*a* can be tightly integrated with the firstly-expanded tube 32 (see FIG. 5).

The firstly-expanded tube 32 is secondly expanded by the circular projected section in a second expansion stage (maximum outer diameter Y of circular projected section of the rear end part 54), so that the fin hole 30*a* is expanded by the secondly-expanded tube 32 in the second expansion stage.

As shown in FIG. 5, the cylindrical section of the front end part 52 is fitted to the inner face of the firstly-expanded tube 32, and the space 34 (see FIG. 2) is not formed. Even if the material of the tube 32 is apt to experience the so-called spring-back phenomenon, the bullet 50 is capable of smoothly expanding the firstly-expanded tube 32 without permitting the spring-back phenomenon.

In the above described embodiments, the tube expanding bullet expands the tube by two stages. However, the bullet may have three or more circular projected sections so as to expand the tube by three stages or more stages. Accordingly, the number of expanding stage is not limited.

In the embodiments, the tube is expanded by one bullet which is capable of expanding by two stages. But the tube may be expanded by a first bullet for firstly expanding to a first expansion stage and a second bullet for secondly expanding in a second expansion stage. Namely, the first bullet is firstly inserted into the tube so as to firstly expand the tube, then the second bullet is inserted into the firstly-expanded tube so as to expand the firstly-expanded tube to a second diameter.

The tube expanding bullet may be used to expand the heat exchanging tubes for room air conditioners, heat exchanging units of chemical plants, etc.

By employing the present invention, the tight contact or fit of the adjacent fins can be prevented, and rate of producing bad heat exchanger components can be reduced.

The invention may be embodied in other specific forms without departing from the spirit or essential characteristics thereof The present embodiments are therefore to be considered in all respects as illustrated and not restrictive, the scope of the invention being indicated by the appended claims rather than by the foregoing description and all changes which come within the meaning and range of equivalency of the claims are therefore intended to be embraced therein.

What is claimed is:

1. A tube expanding bullet for inserting into and expanding a tube, the tube being pierced through a fin hole of a heat exchanging fin having a plurality of collars, said tube expanding bullet comprising:

a first expansion part formed at a front end of said tube expanding bullet, said first expansion part having a diameter greater than an outer diameter of said tube for integrally connecting said tube to said collars; and a second expansion part formed at a rear end of said tube expanding bullet, said second expansion part having a maximum outer diameter greater than a maximum outer diameter of said first expansion part, wherein a first rate of expansion of the fin hole by said first expansion part is less than a second rate of expansion by said second expansion part.

2. The tube expanding bullet according to claim 1, wherein the maximum outer diameter of said first expansion part of said tube expanding bullet imparts a first expanded width of the fin hole and said second expansion part of said tube expanding bullet imparts a second expanded width of the fin hole.

3. The tube according to claim 2, wherein the first expanded width of the fin hole relates to a sum of the first expanded width of the fin hole which has been expanded by said first expansion part and the second expanded width of the fin hole which has been expanded by said second expansion part by a ratio of 1:10.

4. The tube expanding bullet according to claim 1, further comprising:

a first circular projected section having a maximum outer diameter equal to the maximum outer diameter of said first expansion part at the front end of said tube expanding bullet; and a second circular projected section having a maximum outer diameter equal to the maximum outer diameter of said second expansion part formed at the rear end of said tube expanding bullet.

5. The tube expanding bullet according to claim 4, wherein the maximum outer diameter of said first expansion part of said tube expanding bullet imparts a first expanded width of the fin hole and said second expansion part of said tube expanding bullet imparts a second expanded width of the fin hole, the first expanded width of the fin hole relates to a sum of the first expanded width of the fin hole which has been expanded by said first expansion part and the expanded width of the fin hole which has been expanded by said second expansion part by a ratio of 1:10.

6. A method of expanding a tube for a heat exchanger comprising the steps of:

piercing said tube through a plurality of collared fin holes of a plurality of piled heat exchanging fins;

inserting a tube expanding bullet into said tube to expand said tube;

expanding said tube in a first expansion stage by inserting said tube expanding bullet so as to expand the fin holes to a first expansion width and integrally connecting said tube with said collared fin holes; and expanding said tube expanded in said first expansion stage in a successive second expansion stage by said tube expanding bullet to secure said expanded tube with said heat exchanging fins and to impart to a second expansion width to said heat exchanging fins, wherein a first rate of expansion corresponding to said first expansion stage is less than a second rate of expansion corresponding to said second expansion stage.

7. The method according to claim 6, wherein said tube expanding bullet includes a first expansion part formed at a front part of said tube expanding bullet, and a second expansion part having a maximum outer diameter greater than a maximum outer diameter of said first expansion part formed at a rear part of said tube expanding bullet.

8. The method according to claim 6, wherein a ratio of the maximum outer diameter of said first expansion part to a sum of the maximum outer diameter of said first expansion part and the maximum outer diameter of the second expansion part is 1:10.

9. The method according to claim 6, wherein the maximum outer diameter of said first expansion part of said tube expanding bullet imparts a first expanded width of the fin hole and said second expansion part of said tube expanding bullet imparts a second expanded width of the fin hole, the first expanded width relates to a sum of the first expanded width and the second expanded width by a ratio of 1:10.

10. The method according to claim 6, wherein said tube expanding bullet includes a first circular projected section formed at a front part of said tube expanding bullet; and a second circular projected section formed at a rear part of said tube expanding bullet, a maximum outer diameter of said second circular projected portion is greater than a maximum outer diameter of said first circular projected section.

* * * * *